US005569125A

United States Patent [19]

Clementi

[11] Patent Number: 5,569,125

[45] Date of Patent: Oct. 29, 1996

[54] TWIST AND FLEX UPPER BODY SHAPING EXERCISE DEVICE

[76] Inventor: David Clementi, 84 Mayflower Ave., Massapequa Park, N.Y. 11762

[21] Appl. No.: 489,925

[22] Filed: Jun. 12, 1995

[51] Int. Cl.[6] ..... A63B 23/14; A63B 22/02

[52] U.S. Cl. ..... 482/46; 482/126; 482/127

[58] Field of Search ..... 482/46, 44, 45, 482/47, 126, 127

[56] References Cited

U.S. PATENT DOCUMENTS 4,208,047 6/1980 Olsen ..... 482/46
4,805,899 2/1989 Roehlk ..... 482/127
5,002,272 3/1991 Hofmeister ..... 482/127

FOREIGN PATENT DOCUMENTS 2107596 5/1983 United Kingdom ..... 482/46

*Primary Examiner*—Lynne A. Reichard
*Attorney, Agent, or Firm*—Michael I. Kroll

[57] ABSTRACT

A twist and flex upper body shaping exercise device comprising a pair of handles gripped by the hands of a person. A structure extends between the handles, for generating resistance when the handles are twisted in opposite directions by the hands of the person. This causes the resistance generating structure to be flexed spirally, so that the muscles in the hands, arms and shoulders of the person will be toned up.

3 Claims, 2 Drawing Sheets

TWIST AND FLEX UPPER BODY SHAPING EXERCISE DEVICE

BACKGROUND OF THE INVENTION

1. Field of the Invention

The instant invention relates generally to exercising tools and more specifically it relates to a twist and flex upper body shaping exercise device.

Exercise and physical fitness are obviously necessary for athletes, soldiers, firemen, and all those whose jobs require high levels of physical performance. Then why should a sedentary person living in a comfortable, industrialized society exercise?

Medical and health professionals have determined that everyone, depending on the individual's metabolism, has a minimum level of physical activity that must be maintained to prevent serious physical deterioration. The human body and all of its parts, like any living organism, must be used or they atrophy. The loss of structure and function that occurs when a broken arm is immobilized in a cast clearly demonstrates what happens when body parts are not exercised and used.

Basic survival once required the output of enormous physical energy by people on many levels of society. Modern technology has simplified life's physical demands in various ways. Machines from washing machines to automobiles and elaborate industrial equipment have reduced the amount of labor required of people.

In more primitive times most individuals burned up the calories gained from the food they consumed through the rigors of their daily activities. This is no longer true for most people, particularly those living in industrialized nations.

Many people have retained their capacity for physical work. Even those who have been physically inactive for a long time can restore lost physical capability with just a month or two of daily physical training. People who exercise and reach their near-maximum physical capability can maintain it by exercising vigorously on alternate days.

Physical fitness and exercise are important for good physical and mental health, including weight control. Exercise helps the individual develop and maintain a strong self-image and a sense of emotional balance. As a person gets older, exercise becomes more important because after age thirty the heart's blood pumping capacity declines at a rate of about eight percent each decade.

Exercise is also important for children. Vigorous physical activity aids in a child's overall development so he or she reaches optimal size and functional capacities in adulthood. Current research shows that exercise can reduce the accumulation of low density lipoprotein (LDL) and cholesterol on artery walls of children and adults. Excess cholesterol can increase the risk of heart disease. There is, however, no evidence that exercise prolongs life. Former athletes do not live longer than non-athletes, nor are they saved from heart disease. The benefits of exercise cannot be sustained for more than a few months or years without continued exercise. Even Olympic-level athletes will regress rapidly to pre-training levels once they stop exercising. The amount of activity necessary for fitness varies from person to person. Age, physical structure, health, and gender are contributing factors.

Most common forms of exercise, such as bicycling and swimming, rarely cause serious injury. But contact sports, such as football and judo, can cause wear on the joints that can lead to articular disease, or joint problems. The problem for most beginners is over exercise. Many people experience stiffness after the first day of exercise, but this is harmless and does not last long. People who are overweight, past middle age, or who suffer from heart disease should consult a physician before starting any exercise program. Sometimes children who are involved in competitive sports suffer from muscle and joint problems.

Today's sedentary man who is past age 30 begins to think about fitness for his survival as he sees his older friends, who are in their forties, die of heart attacks. Some researchers estimate that people who maintain a moderately high level of physical activity can reduce the risk of coronary heart disease by about a third. Exercise also aids in eliminating such other conditions as obesity and high blood pressure, which are amount the cause of heart disease.

To achieve maximum cardiovascular benefits from aerobic exercise, exercise professionals recommend elevating the heartbeat to approximately seventy percent of the individual's maximum heart rate. Once that elevated rate is achieved during exercise, continue exercising to maintain the rate for thirty minutes. This regime should be repeated three times each week.

To calculate the maximum heart rate, an individual should subtract his or her age from 220. Multiply the remainder by seventy percent. For example, a forty year old woman subtracts 40 from 220 for a maximum heartbeat rate of 180. Multiplying 180 by 0.7 tells her that she should exercise to elevate her heartbeat to 126 beats per minute and maintain that rate of 126 per minute for thirty minutes three times a week. The seventy percent figure is an average. The range is sixty to eighty percent. Older people, or those just starting an exercise program will aim for the sixty percent level, while more active individuals who are more physically fit will strive to reach eighty.

The person who has been idle for years does not benefit from a crash attempt to make up for lost years of exercise by an exhaustive regimen. This can do more harm than good. Exercise can be harmful in various circumstances, particularly if people overexert themselves or do not perform the exercises correctly.

2. Description of the Prior Art

Numerous exercising tools have been provided in prior art that are adapted to be made for use by adults and children to promote good heath and body-building. While these units may be suitable for the particular purpose to which they address, they would not be as suitable for the purposes of the present invention as heretofore described.

SUMMARY OF THE INVENTION

A primary object of the present invention is to provide a twist and flex upper body shaping exercise device that will overcome the shortcomings of the prior art devices.

Another object is to provide a twist and flex upper body shaping exercise device that will allow a person to exercise for developing the hands, arms and shoulders by gripping two handles on opposite sides of a strong pliable hollow tubular casing and rotate the handles in opposite directions to generate resistance.

An additional object is to provide a twist and flex upper body shaping exercise device that is resistant to compression, extension and being bent away from a longitudinal axis by two inner rods interconnected by a sleeve.

A further object is to provide a twist and flex upper body shaping exercise device that is simple and easy to use.

A still further object is to provide a twist and flex upper body shaping exercise device that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein.

Similar reference characters denote corresponding features consistently throughout the attached drawings.

DETAILED DESCRIPTION OF THE PREFERRED EMBODIMENTS

Figure 1:
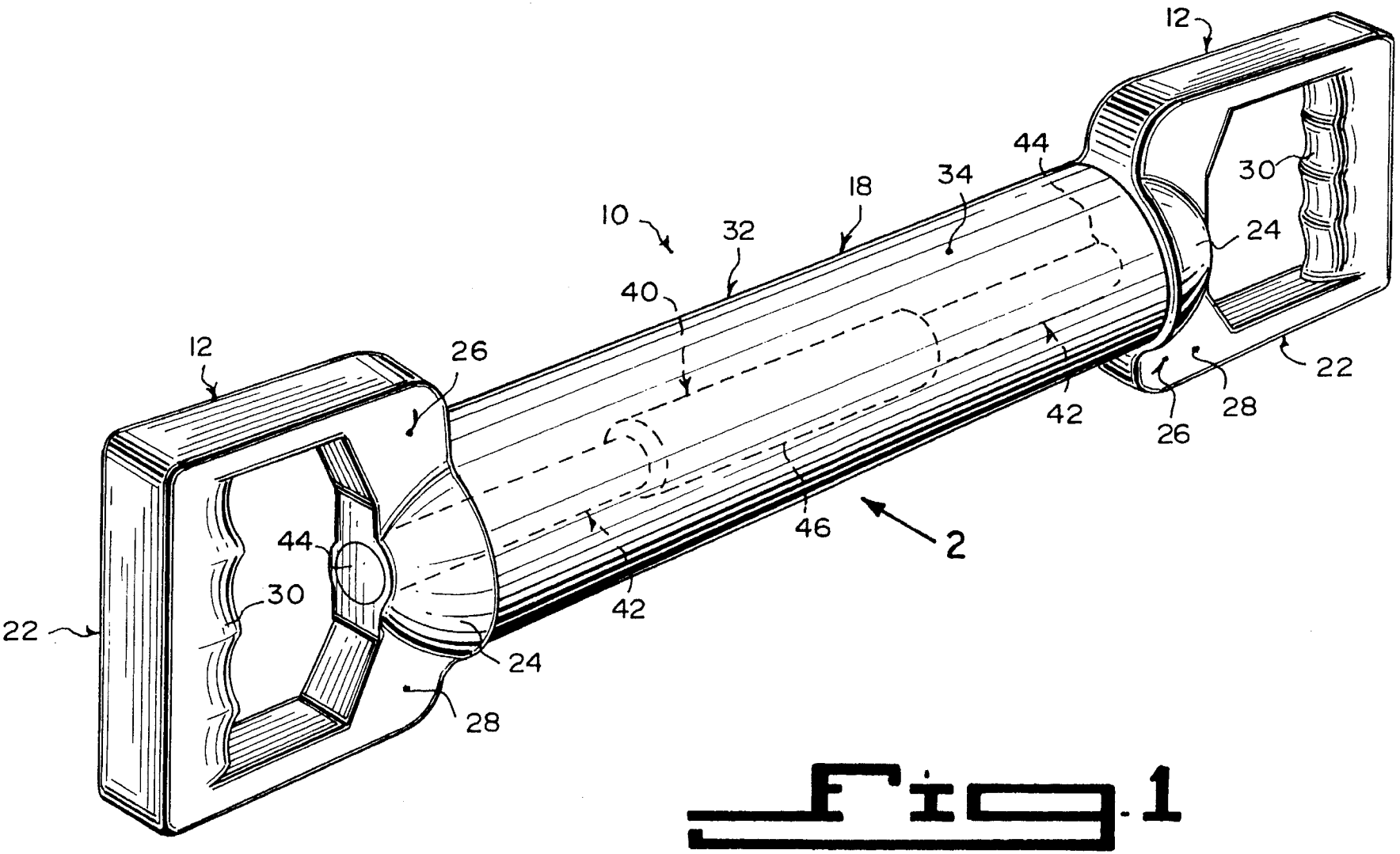
FIG. 1 is a perspective view of the instant invention.
Figure 2:
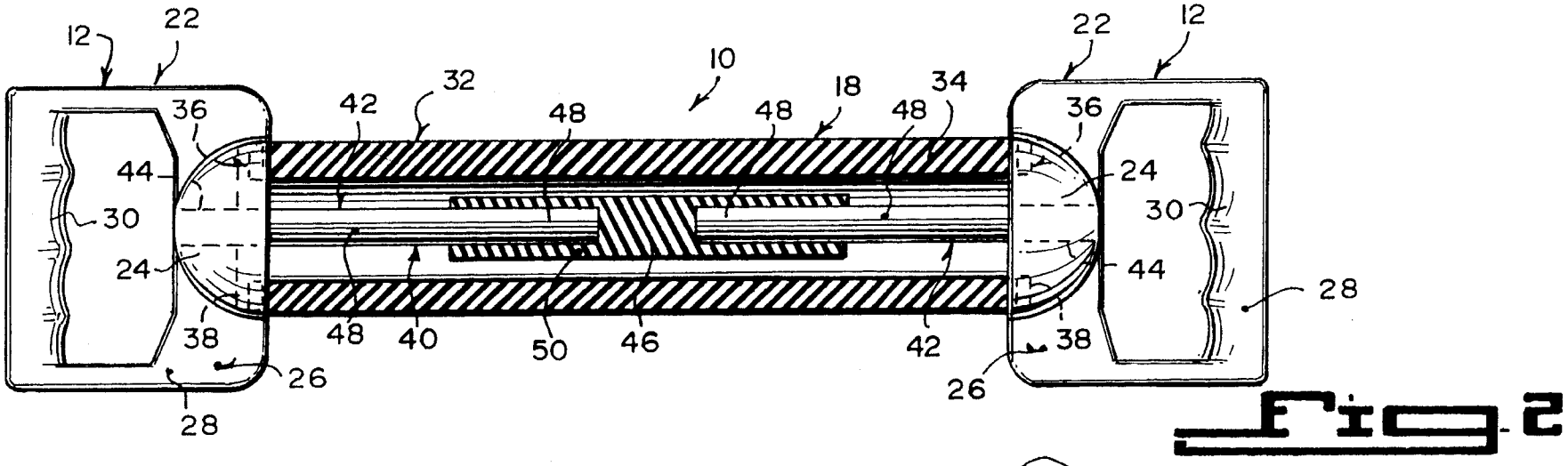
FIG. 2 is a front elevational view taken in the direction of arrow 2 with the hollow tubular casing and inner sleeve in section.
Figure 3:
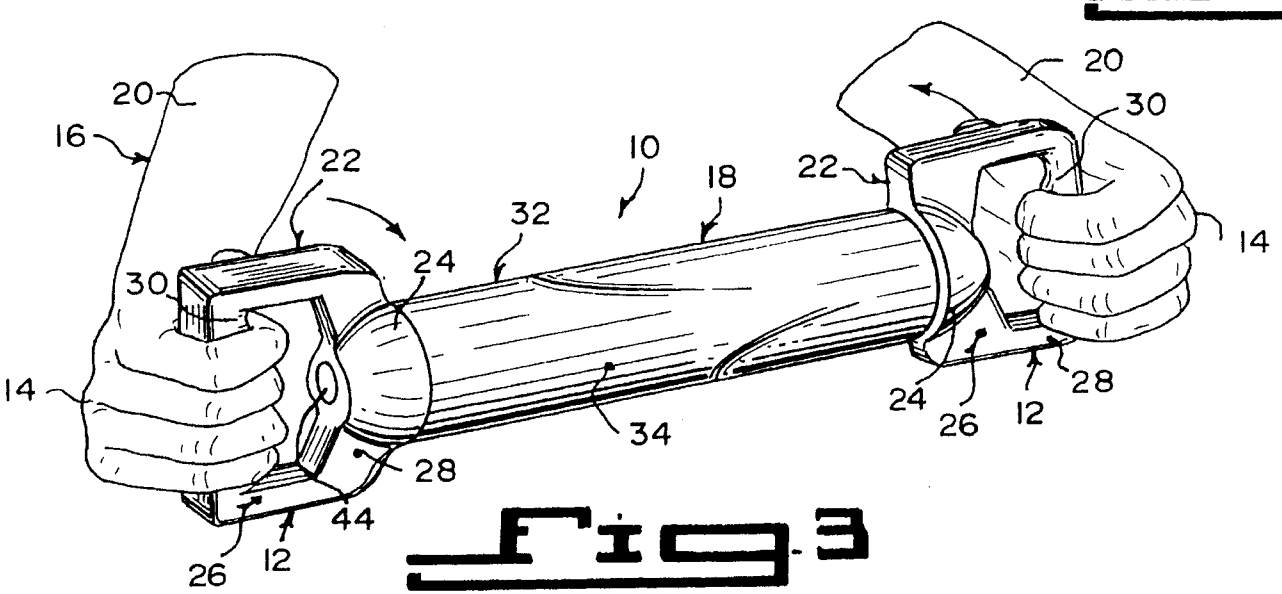
FIG. 3 is a perspective view showing the instant invention in use.

Turning now descriptively to the drawings, in which similar reference characters denote similar elements throughout the several views, FIGS. 1 through 3 illustrate a twist and flex upper body shaping exercise device 10, comprising a pair of handles 12 gripped by the hands 14 of a person 16. A structure 18 extends between the handles 12, for generating resistance when the handles 12 are twisted in opposite directions by the hands 14 of the person 16. This causes the resistance generating structure 18 to be flexed spirally, so that the muscles in the hands 14, arms 20 and shoulders of the person 16 will be toned up.

Each handle 12 is a D-shaped member 22 having a cup 24 on one end to receive one end of the resistance generating structure 18. Each handle 12 is fabricated out of a strong durable material 26. The strong durable material is plastic 28. Each handle 12 also includes finger grips 30, so that the handle 12 can be tightly grasped by the hand 14 of the person 16.

The resistance generating structure 18 is an elongated heavy flexible cylindrical hose 32. The elongated heavy flexible cylindrical hose 32 is made out of rubber 34.

The twist and flex upper body shaping exercise device 10 further includes a facility 36, for retaining each end of the resistance generating structure 18 to one handle 12. Each retaining facility 36 includes a plurality of holding tabs 38.

An assembly 40 is for maintaining the resistance generating structure 18 in a straight line when being flexed spirally. The assembly 40 maintaining assembly 40 includes a pair of rods 42. Each rod 42 is affixed at a first end 44 to the handle 12, so that the rod 42 can extend longitudinally into the resistance generating structure 18. A sleeve 46 engages with a second end 48 of each rod 42, so as to prevent the resistance generating structure 18 from being compressed. Each rod 42 is made out of plastic 48. The sleeve 46 is made out of hard rubber 50.

OPERATION OF THE INVENTION

To use the twist and flex upper body shaping exercise device 10, the following steps should be taken:

1. Hold each handle 12 by each hand 14.
2. Rotate one handle 12 in a first direction.
3. Rotate the other handle 12 in a second opposite direction to spirally flex the heavy flexible cylindrical hose 32.
4. Now rotate the first handle 12 in the second opposite direction.
5. Now rotate the other handle 12 in the first direction.
6. Do steps 2 to 5 over and over again, so that the hands 14 arms 20 and shoulders will become toned up.

LIST OF REFERENCE NUMBERS

10 twist and flex upper body shaping exercise device
12 handle of 10
14 hand of 16
16 person
18 resistance generating structure of 10
20 arm of 16
22 D-shaped member for 12
24 cup of 22
26 strong durable material of 12
28 plastic for 26
30 finger grip on 12
32 elongated heavy flexible cylindrical hose for 18
34 rubber for 32
36 retaining facility
38 holding tab
40 maintaining assembly
42 rod of 40
44 first end of 42
46 sleeve
48 plastic for 42
50 hard rubber for 46

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A twist and flex upper body shaping exercise device comprising:

a) a pair of handles, each said handle being a "D"-shaped member having a cup on one end to receive one end of said resistance generating means, each said handle being fabricated out of a strong durable material, said strong durable material being plastic, and each said handle including finger grips;

b) means extending between said handles, for generating resistance when said handles are twisted in opposite directions by the hands of the person, to cause said resistance generating means to be flexed spirally, said resistance generating means being an elongated heavy flexible cylindrical hose, said elongated heavy flexible cylindrical hose being made out of rubber;

c) means for retaining each end of said resistance generating means to one said handle, said retaining means including a plurality of holding tabs; and d) means for maintaining said resistance generating means in a straight line when being flexed spirally, said maintaining means including a pair of rods in which each said rod is affixed at a first end to said handle, so that said rod can extend longitudinally into said resistance generating means, and a sleeve to engage with a second end of each said rod, so as to prevent said resistance generating means from being compressed.

2. A twist and flex upper body shaping exercise device as recited in claim 1, wherein each said rod is made out of plastic.

3. A twist and flex upper body shaping exercise device as recited in claim 1, wherein said sleeve is made out of hard rubber.

* * * * *